US009187932B1

(12) United States Patent
Chen et al.

(10) Patent No.: US 9,187,932 B1
(45) Date of Patent: Nov. 17, 2015

(54) LOCK DEVICE WITH POSITIONING ASSEMBLY FOR TWO-WAY TRAVEL DRAWER

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE CO., LTD., Taichung (TW)

( * ) Notice: Subject to any disclaimer, the term of this patent is extended or adjusted under 35 U.S.C. 154(b) by 0 days.

(21) Appl. No.: 14/329,934

(22) Filed: Jul. 12, 2014

(51) Int. Cl.
*E05B 65/46* (2006.01)

(52) U.S. Cl.
CPC ..... *E05B 65/462* (2013.01); *E05B 65/467* (2013.01)

(58) Field of Classification Search
CPC ..... E05B 65/462; E05B 65/0003
USPC ..... 312/215–222; 292/137, 138, 340, 292/DIG. 18, DIG. 40
See application file for complete search history.

(56) References Cited

U.S. PATENT DOCUMENTS 1,422,631 A * 7/1922 Stafford ..... 312/219
3,401,998 A * 9/1968 Evans et al. ..... 312/215
3,764,190 A * 10/1973 Anderson ..... 312/286
3,870,387 A * 3/1975 Mortashed ..... 312/218
4,033,157 A * 7/1977 Williams ..... 70/85
4,480,883 A * 11/1984 Young ..... 312/220
4,768,844 A * 9/1988 Ludwig ..... 312/221
4,889,396 A * 12/1989 Mitchell et al. ..... 312/221
4,936,640 A * 6/1990 Pratzer ..... 312/221
5,056,877 A * 10/1991 Westwinkel ..... 312/221
5,074,627 A * 12/1991 Broeders ..... 312/221
5,176,436 A * 1/1993 Mitchell ..... 312/221
5,599,078 A * 2/1997 Dechene et al. ..... 312/221
5,702,167 A * 12/1997 Muller ..... 312/221
5,772,294 A * 6/1998 Hendrich et al. ..... 312/221
5,829,859 A * 11/1998 Cram ..... 312/221
5,997,114 A * 12/1999 Bischoff ..... 312/215
6,082,839 A * 7/2000 Chiku ..... 312/219
8,511,765 B1 * 8/2013 Chen et al. ..... 312/333
8,651,591 B1 * 2/2014 Chen et al. ..... 312/218
8,770,680 B1 * 7/2014 Chen et al. ..... 312/221
2004/0051425 A1 * 3/2004 Chen ..... 312/217
2005/0023942 A1 * 2/2005 Kunanantakul ..... 312/221
2006/0066187 A1 * 3/2006 Chang ..... 312/219
2006/0197416 A1 * 9/2006 Tsai ..... 312/217
2008/0054768 A1 * 3/2008 Lin ..... 312/221
2008/0231150 A1 * 9/2008 Grela et al. ..... 312/218
2009/0160298 A1 * 6/2009 Chen et al. ..... 312/333

* cited by examiner

*Primary Examiner* — Matthew Ing

(57) ABSTRACT

A lock device for a plurality of two-way travel drawers of a support body is provided with a positioning assembly including two links, two bending members, two biasing elements, and two triggers. The link includes a first enlargement proximate to a first end, an intermediate second enlargement, an extension extending inward from the second enlargement, an inclined section interconnecting the extension and a second end; the bending member secured to the support body and includes a vertical section having a third through hole; the first end is moveably disposed through the support body; each trigger is disposed on the first end and exposed; each biasing element is put on the extension and anchored between the second enlargement and the bending member; and the second end passes through the vertical section of the bending member; and the first enlargement is stopped by the support body in an inoperative position.

9 Claims, 9 Drawing Sheets

LOCK DEVICE WITH POSITIONING ASSEMBLY FOR TWO-WAY TRAVEL DRAWER

BACKGROUND OF THE INVENTION

1. Field of the Invention

The invention relates to drawer slides and more particularly to a lock device having a spring actuated positioning assembly for a two-way travel drawer.

2. Description of Related Art

A drawer is a box shaped container that fits into a piece of furniture in such a way that it can be drawn out horizontally to access its contents. However, typical drawers are designed to open or close from a front end of the drawer but not from either the front end or the rear end of the drawer.

Drawer locks are well known. For example, U.S. Utility application Ser. No. 13/804,988 discloses a lock device for a two-way travel drawer which has the same inventor as the present application.

However, lacking a positioning assembly of the lock device for the conventional drawer adversely affects its reliability. Hence, a need has arisen for an improved lock device for a two-way travel drawer in order to overcome the inadequacy of the prior disclosure and contribute significantly to the advancement of the art.

SUMMARY OF THE INVENTION

It is therefore one object of the invention to provide a lock device for a plurality of two-way travel drawers of a support body, comprising in combination a plurality of pegs each disposed on one side of one of the two-way travel drawers; a plurality of two two-way travel slides each disposed on an outer surface of either side of one of the two-way travel drawers; a lock assembly longitudinally mounted on one side of the support body and comprising a groove member, a sliding member, a biasing member, a lock, and a plurality of snapping members wherein the groove member includes front and rear flanges and an upward bend on an upper portion proximate to the rear flange; the sliding member is disposed in the groove member and includes an upper hook, and two opposite upright retaining members on tops of front end rear edges respectively, each of the retaining members having a second through hole; the biasing member interconnects the bend and the hook so that the sliding member is capable of sliding about the groove member; the lock is disposed on an upper portion of an inner surface of one side of the support body for stopping the sliding member from moving out of its confined range; and each of the snapping members includes two latches on front and rear ends respectively, the latches secured to the sliding member, a central trough on a bottom, and two curved surfaces each extending from the trough to either latch; and a positioning assembly comprising two links, two bending members, two biasing elements, and two triggers wherein the link includes a first enlargement proximate to a first end, an intermediate second enlargement, an extension extending inward from the second enlargement, an inclined section interconnecting the extension and a second end; the bending member secured to an inner surface of one side of the support body and includes a vertical section having a third through hole; the first end is moveably disposed through a rear surface or a front surface of the support body; each of the triggers is disposed on the first end and spaced from the rear surface or the front surface of the support body; each of the biasing elements is put on the extension and anchored between the second enlargement and the vertical section of the bending member; and the second end passes through the third through hole of the vertical section of the bending member to be proximate to the lock with both the inclined section and a portion of the extension disposed between the vertical section of the bending member and the retaining member; and the first enlargement is stopped by the rear surface or the front surface of the support body in an inoperative position; wherein in an unlocked position of the two-way travel drawer in response to pushing one trigger to compress the corresponding biasing element, the corresponding inclined section inserts through the second through hole of the corresponding retaining member to lift one of the snapping members, and the trough of the snapping member disengages from the corresponding one of the pegs, thereby unlocking one of the two-way travel drawers.

The above and other objects, features and advantages of the invention will become apparent from the following detailed description taken with the accompanying drawings.

DETAILED DESCRIPTION OF THE INVENTION

Figure 1:
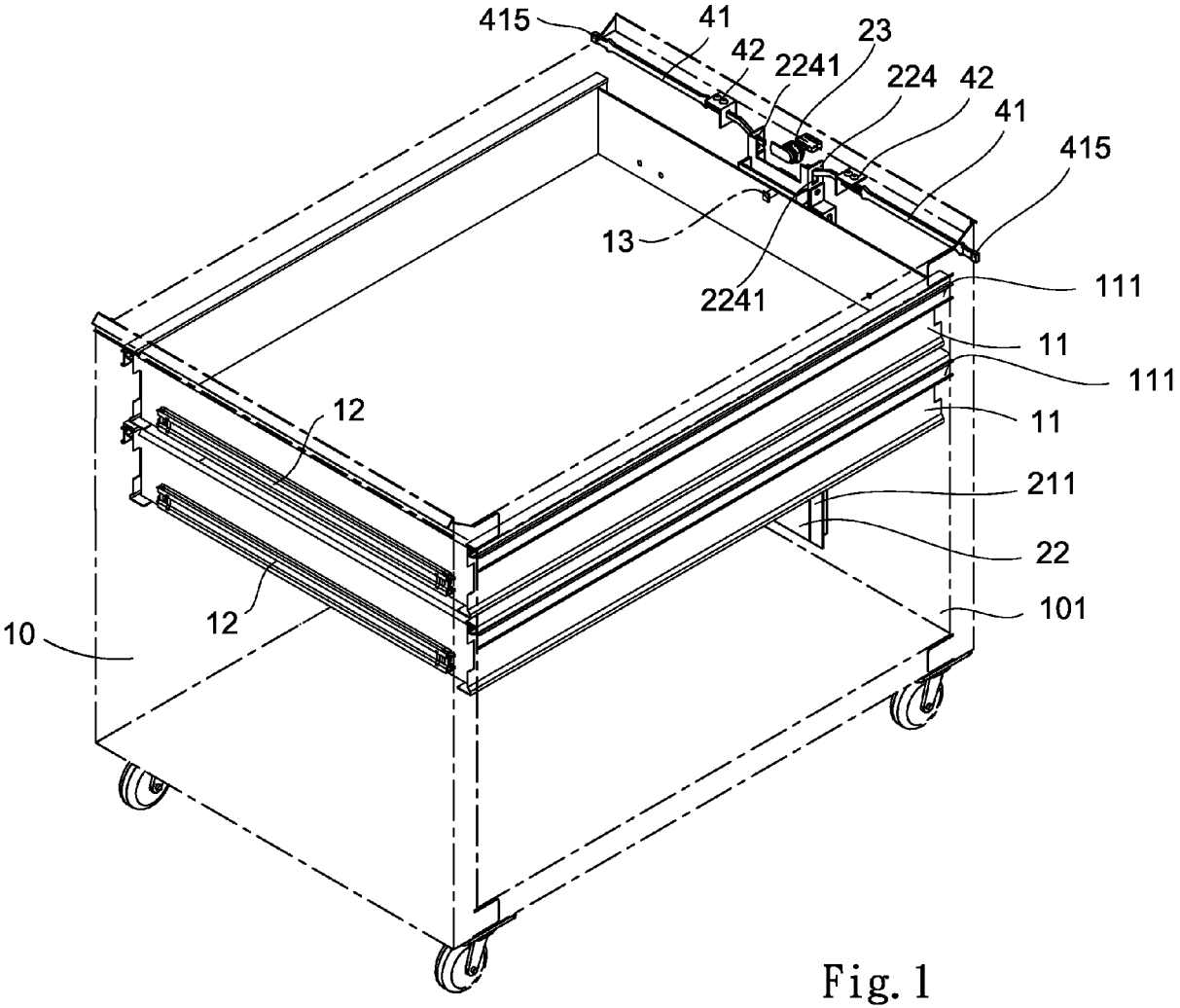
FIG. 1 is a perspective view of a cart having a plurality of two-way travel drawers incorporating a lock device according to the invention.
Figure 2:
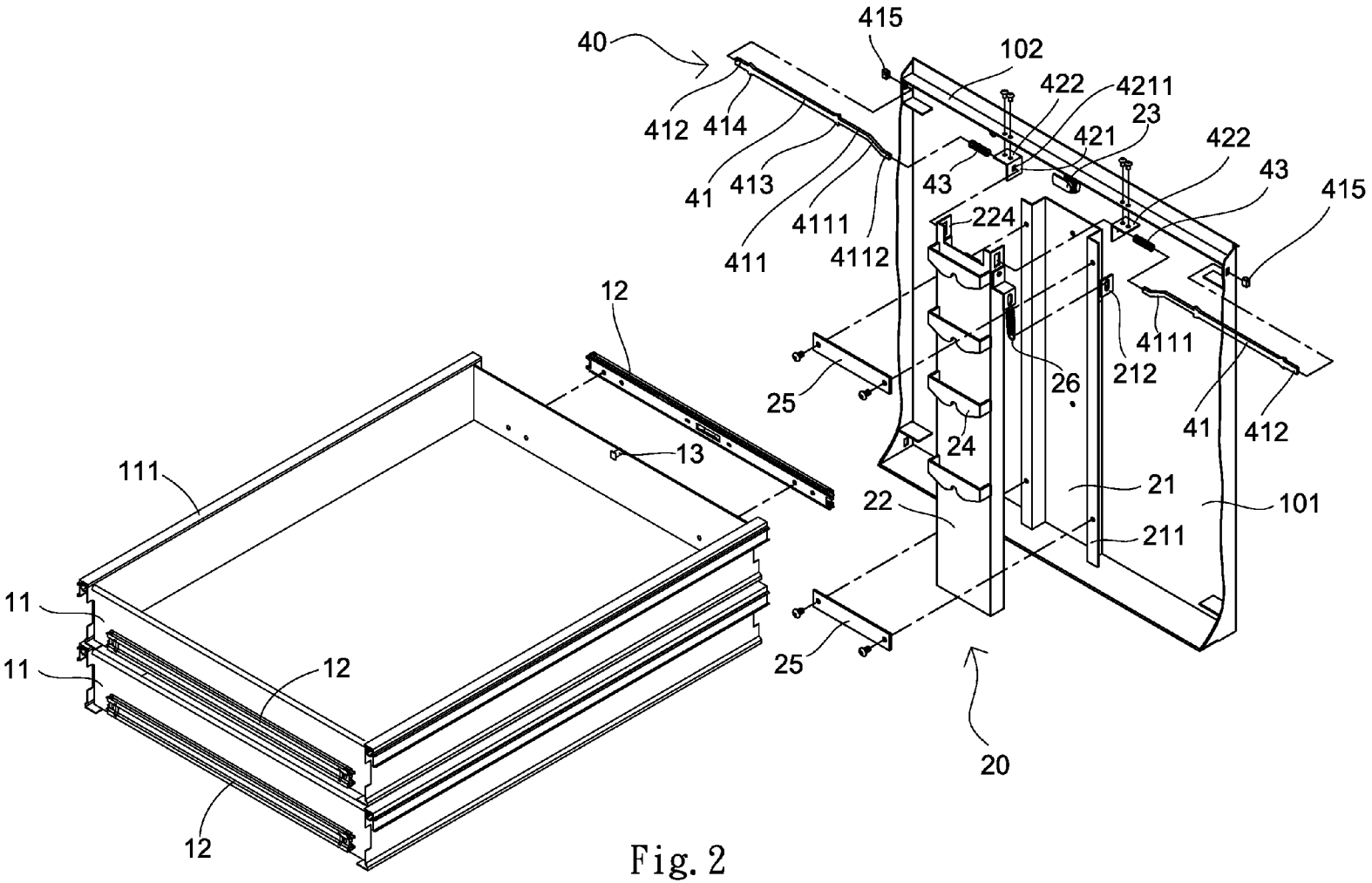
FIG. 2 is an exploded perspective view of the lock device with the associated slide detached from the drawer side.
Figure 3:
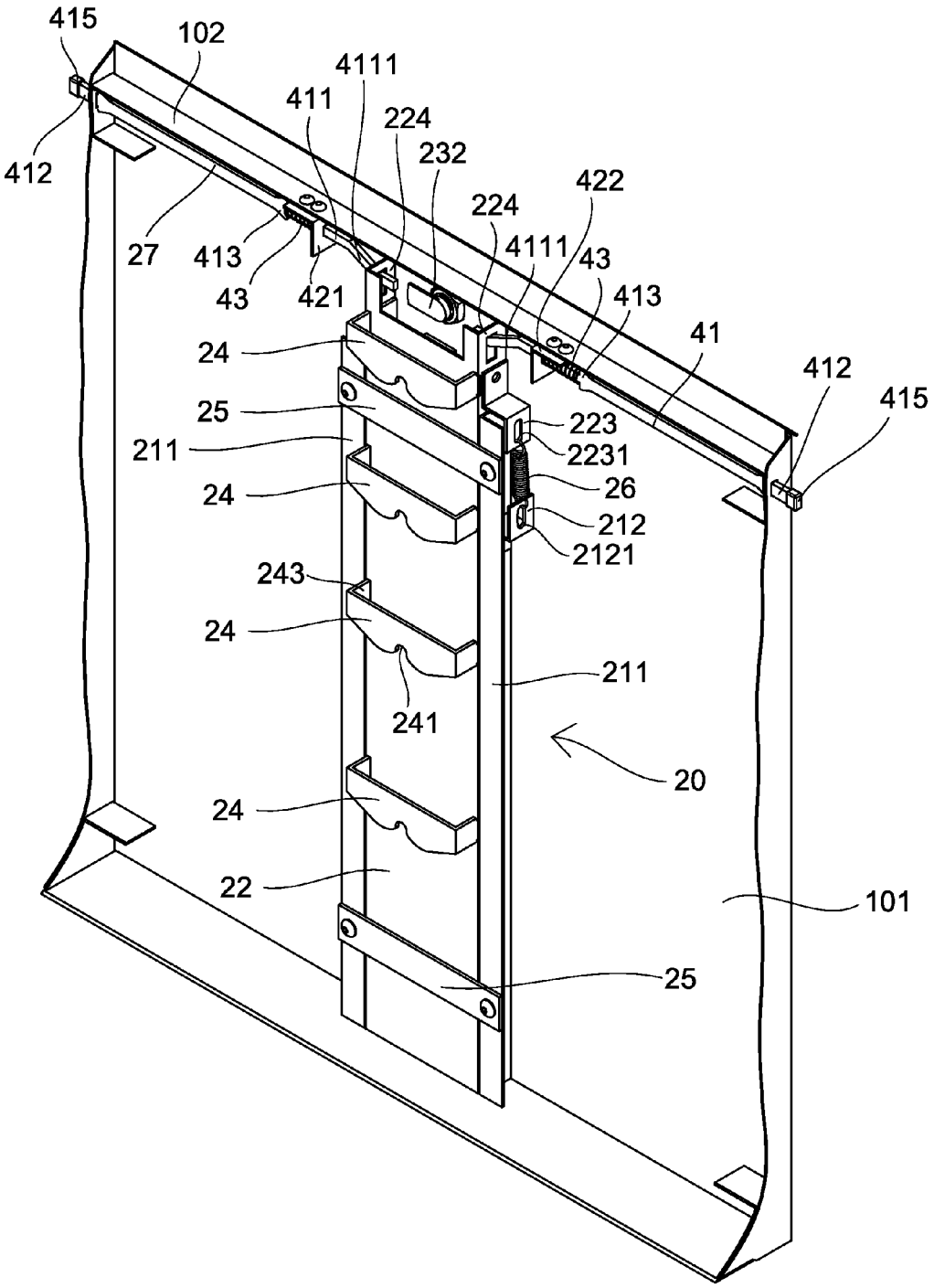
FIG. 3 is a perspective view of the assembled lock device of FIG. 2.
Figure 3A:
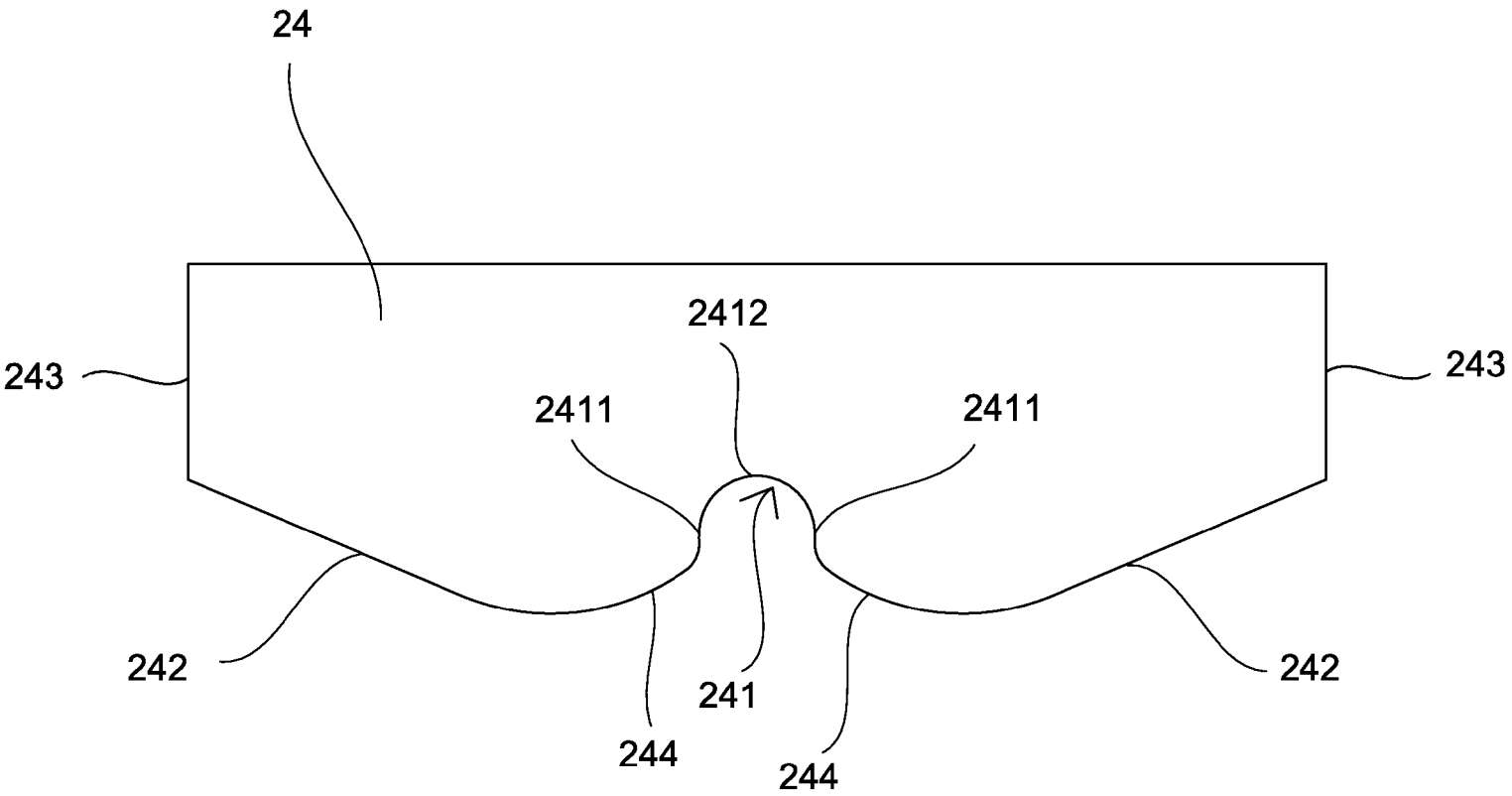
FIG. 3A is a plan view of the snapping member.

Referring to FIGS. 1 to 8, a lock device for a two-way travel drawer in accordance with the invention is shown and comprises in combination following components.

A cart 10 is a hollow structure having a plurality of drawers 11 disposed vertically. A peg 13 is provided on a central portion of one side of each drawer 11. A slide (e.g., two-way travel slide) 12 is lengthwise provided on an outer surface of each side of the drawer 11. The drawer 11 has a handle 111 on a top edge of each of front and rear ends.

A lock assembly 20 is longitudinally mounted on one side 101 of the cart 10 and comprises a longitudinal groove member 21, a sliding member 22, a lock 23, and a plurality of snapping members 24. The groove member 21 has an n-shaped section and comprises front and rear flanges 211, and an upward bend 212 on an upper portion of a rear edge, a first through hole 2121 through a vertical section of the bend 212. The sliding member 22 has an n-shaped section and is shaped to slidably dispose in the groove member 21 by threadedly driving a plurality of fasteners (not numbered) through a plurality of inner, rectangular plates 25 and the front and rear flanges 211.

The sliding member 22 comprises an upper, bent stop member 222 on an upper portion of the back, an upper hook 223 on a rear edge, and a hole member 2231 through a lower, vertical section of the hook 223. A torsion spring 26 has one end fastened in the hole member 2231 and the other end fastened in the first through hole 2121. Thus, the sliding member 22 may slide about the groove member 21 by expanding or compressing the spring 26. The lock 23 is disposed on an upper portion of an inner surface of one side of the cart 10 and served as a stop of the sliding member 22 in an upward movement of the sliding member 22. The lock 23 comprises a threaded nut 231 at one end mounted on the wall of the cart 10, and an arm 232 at the other end rotatably fastened in the nut 231. The sliding member 22 further comprises two opposite upright retaining members 224 on tops of front and rear edges respectively. Each retaining member 224 has a second through hole 2241 facing the second through hole 2241 of the other retaining member 224.

The snapping member 24 comprises two latches 243 on front and rear ends respectively, a trough 241 on a central portion of a bottom edge, two inclined surfaces 242 each extending from the trough 241 to either latch 243, and two curved surfaces 244 each interconnecting the trough 241 and either inclined surface 242. The trough 241 includes two opposite flat surfaces 2411 each connecting the curved surface 244, and a curved section 2412 interconnecting the flat surfaces 2411. The latches 243 are horizontally retained in the front and rear flanges 211. Thus, the snapping members 24 are secured to and equally spaced apart on an inner surface of the sliding member 22.

A positioning assembly 40 comprises two elongated links 41, two bending members 42, and two torsion springs 43. The link 41 includes a first enlargement 414 proximate to a first end 412, an intermediate second enlargement 413, an extension 411 extending inward from the second enlargement 413, an inclined section 4111 interconnecting the extension 411 and a second end 4112. The bending member 42 includes a vertical section 421 having a third through hole 4211, and a horizontal section 422 secured to a lengthwise member 102 formed on an upper portion of an inner surface of the side 101 by using fasteners (not numbered). The first end 412 disposed through an opening (not numbered) on a rear surface or a front surface of the cart 10, and a trigger 415 is disposed on the first end 412 and spaced from the opening. The torsion spring 43 is put on the extension 411 and anchored between the second enlargement 413 and the vertical section 421 of the bending member 42. The second end 4112 passes through the third through hole 4211 to be proximate to the lock 23 with both the inclined section 4111 and a portion of the extension 411 disposed between the vertical section 421 of the bending member 42 and the retaining member 224. Further, the first enlargement 414 is stopped by the rear or front surface of the cart 10 in an inoperative position.

Figure 4:
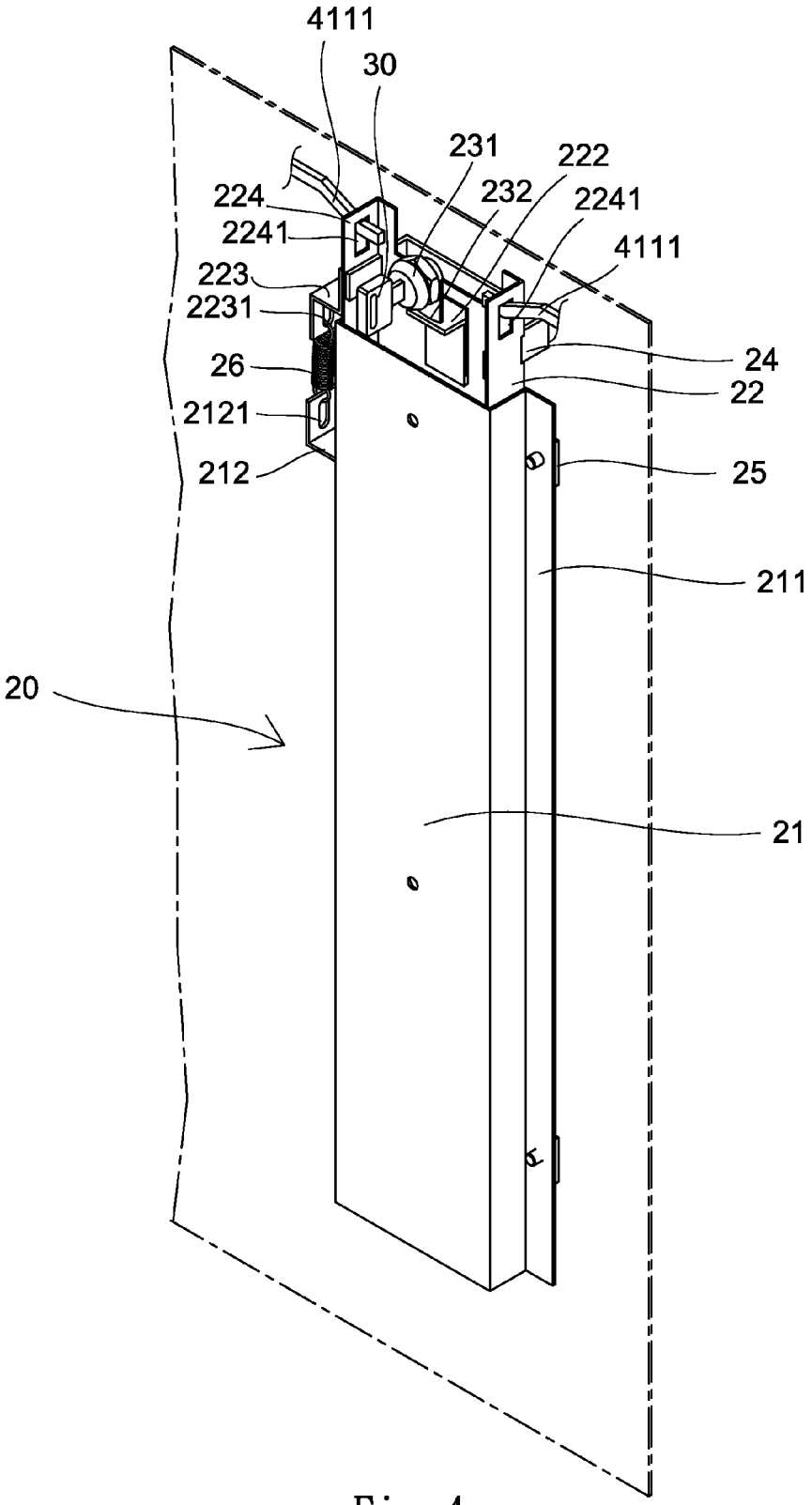
FIG. 4 is a perspective view of the lock device of FIG. 3 but viewing from an opposite angle.
Figure 5:
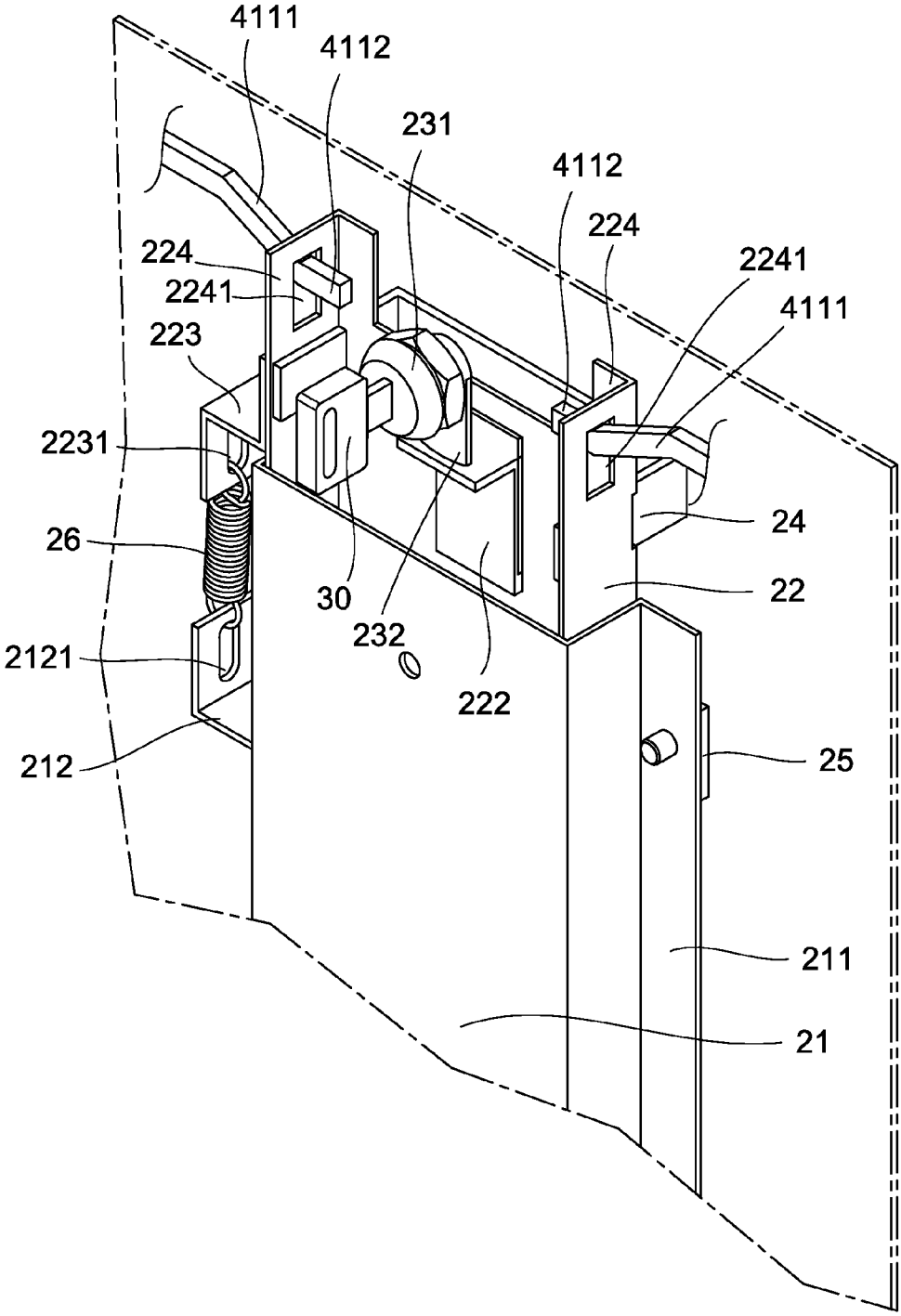
FIG. 5 is an enlarged view of an upper portion of FIG. 4.

Locking operation of the invention is detailed below. As shown in FIGS. 4 and 5, an individual may insert a key 30 into a key hole of the nut 231 and then counterclockwise rotate the arm 232 until being stopped. At this position, the top of the stop member 222 is urged against by the end of the arm 232. As a result, the drawer 11 is locked.

Unlocking operation of the invention is detailed below. The individual may insert the key 30 into the key hole of the nut 231 and then clockwise rotate the arm 232 until being stopped. At this position, the top of the stop member 222 is disengaged from the end of the arm 232. As a result, the drawer 11 is unlocked.

Figure 6:
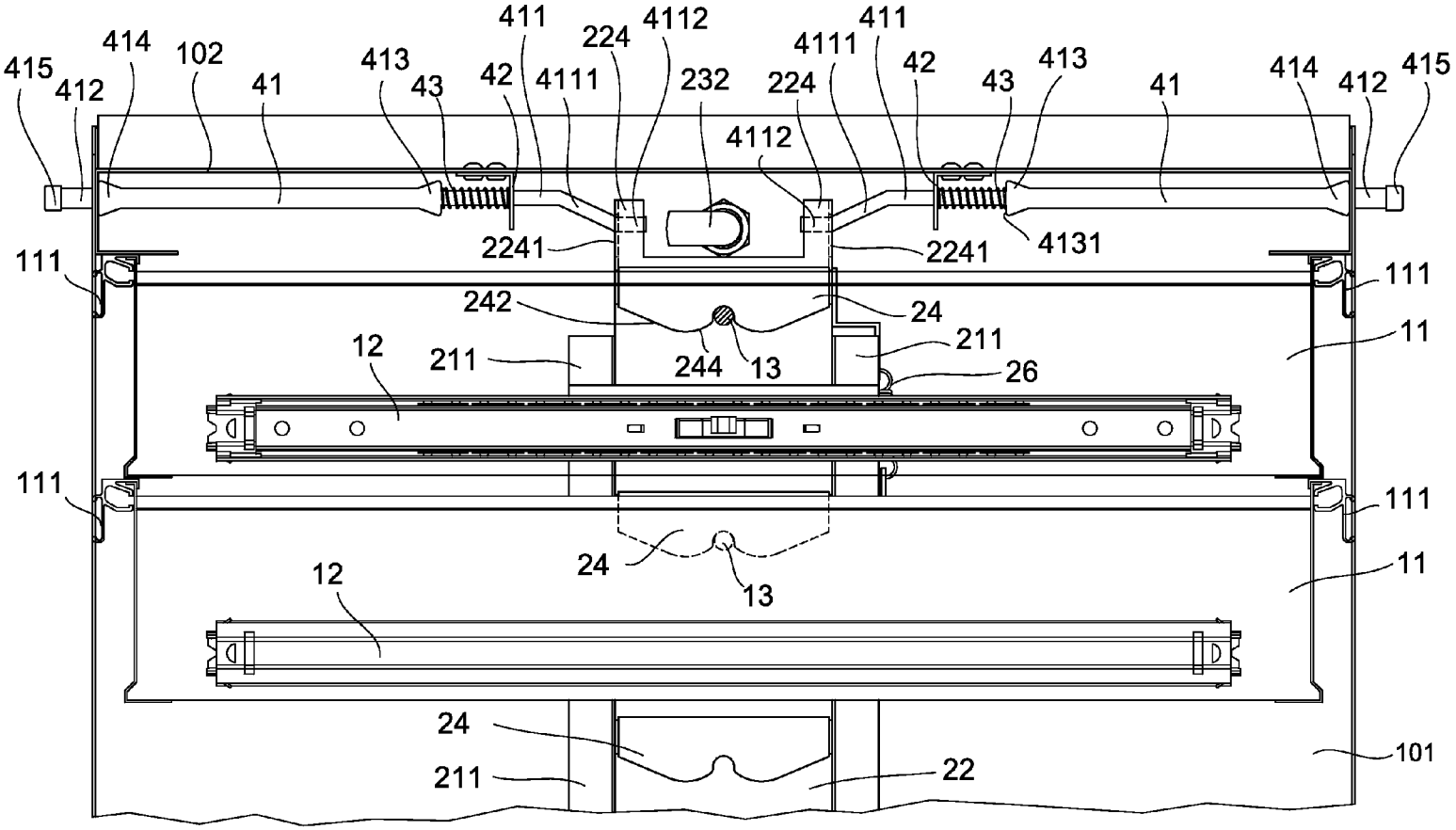
FIG. 6 is a side elevation showing the drawer being unlocked and the positioning assembly being in an inoperative position.
Figure 7:
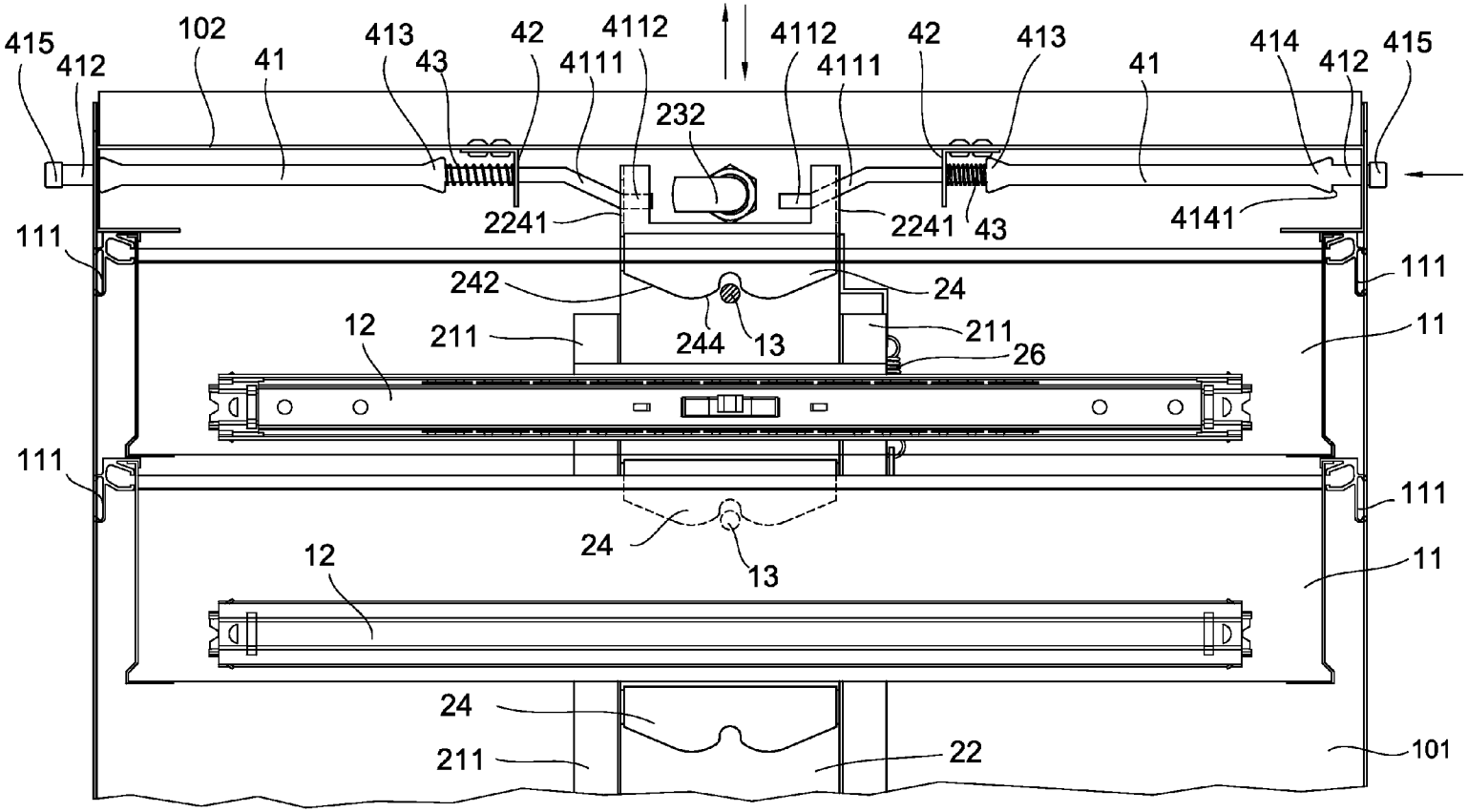
FIG. 7 is a view similar to FIG. 6 showing an operation of pushing the front trigger to compress the corresponding torsion spring and lift and disengage the snapping member from the peg.
Figure 8:
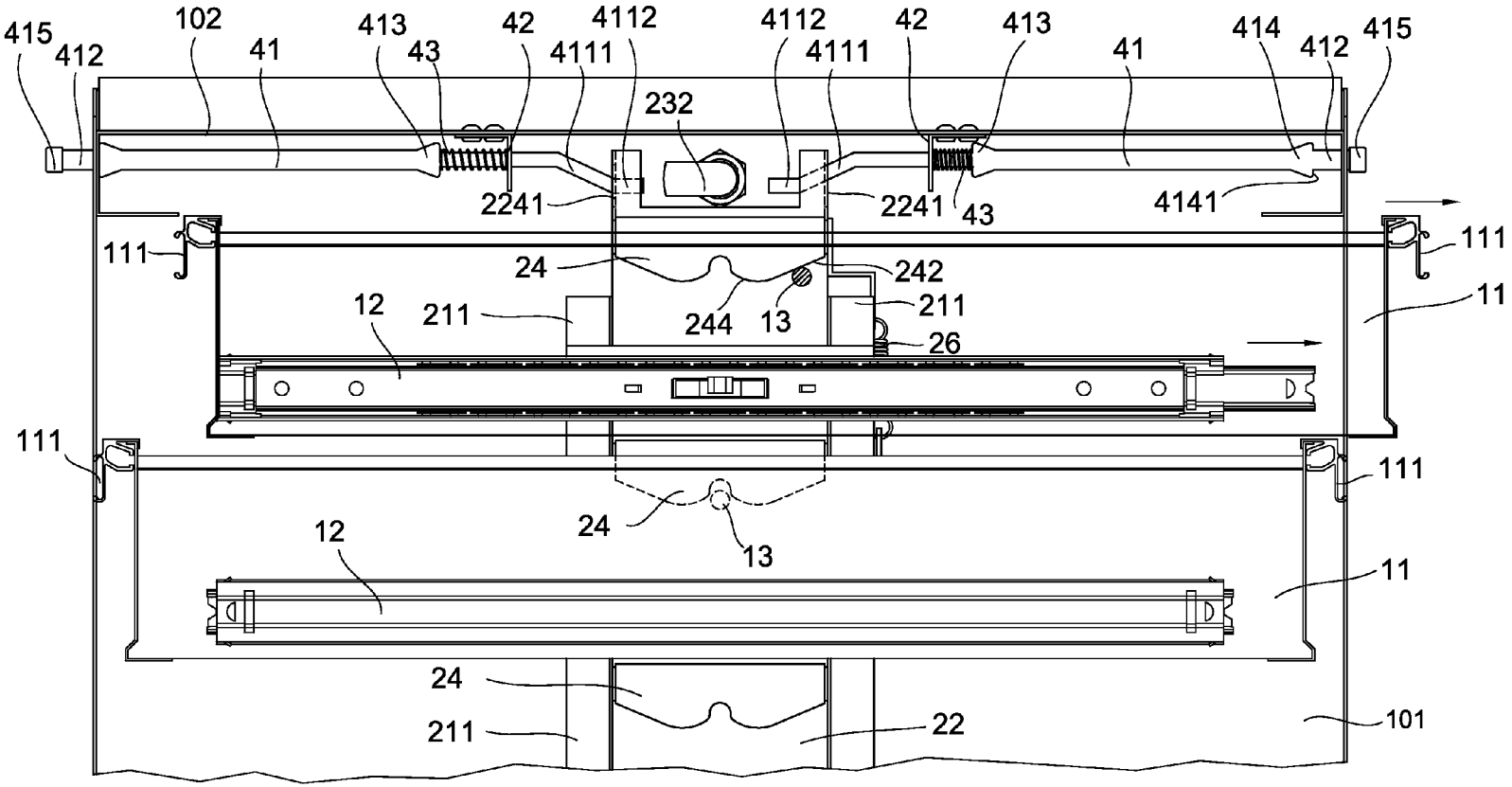
FIG. 8 is a view similar to FIG. 7 showing the drawer being pulled with the peg riding along the curved bottom of the snapping member.

Positioning operation of the invention is detailed below. As shown in FIG. 6, the drawer 11 is unlocked and closed. Next, the individual may push the front trigger 415 to compress the corresponding torsion spring 43, the inclined section 4111 inserts through the second through hole 2241 of the corresponding retaining member 224 to lift the snapping member 24, and thus the trough 241 of the snapping member 24 disengages from the peg 13 (see FIG. 7). The maximum distance that the trigger 415 can be pushed is the distance between the trigger 415 and the first enlargement 414. Thereafter, the individual may pull the drawer (e.g., the topmost drawer) 11 to open it (as indicated by arrow) with the peg 13 riding along the curved surface 244 to the inclined surface 242 (see FIG. 8). It is understood that after accessing articles in the drawer 11 a releasing of the trigger 415 can return the positioning assembly 40 to its original, inoperative position as shown in FIG. 6.

Further, in the closed and locked states of the drawer 11, that is, one drawer 11 is disposed in the cart 10 and is not locked, a user may push the drawer 11 into the art 10 to be positioned in which the peg 13 of the drawer 11 moves along the corresponding inclined surface 242 and the curved surface of the snapping member 24 to push the snapping member 24, thereby lifting both the snapping member 24 and the sliding member 22. Furthermore, the peg 13 of the drawer 11 can be guided to position between two flat surfaces 2411 of the trough 241 even when the user exerts an excessive force in pushing the drawer 11 for closing. And in turn, weight of the sliding member 22 and an expanding force of the compressed spring 26 cause the peg 13 to correctly dispose in the desired position. As a result, the drawer 11 is locked.

While the invention has been described in terms of preferred embodiments, those skilled in the art will recognize that the invention can be practiced with modifications within the spirit and scope of the appended claims.

What is claimed is:

1. A lock device of a plurality of two-way travel drawers of a support body, comprising in combination:

a plurality of pegs each disposed on one side of one of the two-way travel drawers;

a plurality of two two-way travel slides each disposed on an outer surface of either side of one of the two-way travel drawers;

a lock assembly longitudinally mounted on one side of the support body and comprising a groove member, a sliding member, a biasing member, a lock, and a plurality of snapping members wherein the groove member includes front and rear flanges and an upward bend on an upper portion proximate to the rear flange; the sliding member is disposed in the groove member and includes an upper hook, and two opposite upright retaining members on tops of front end rear edges respectively, each of the retaining members having a second through hole; the biasing member interconnects the bend and the hook so that the sliding member is capable of sliding about the groove member; the lock is disposed on an upper portion of an inner surface of one side of the support body for stopping the sliding member from moving out of its confined range; and each of the snapping members includes two latches on front and rear ends respectively, the latches secured to the sliding member, a central trough on a bottom, and two curved surfaces each extending from the trough to either latch; and a positioning assembly comprising two links, two bending members, two biasing elements, and two triggers wherein the link includes a first enlargement proximate to a first end, an intermediate second enlargement, an extension extending inward from the second enlargement, an inclined section interconnecting the extension and a second end; the bending member secured to the inner surface of one side of the support body and includes a vertical section having a third through hole; the first end is moveably disposed through a rear surface or a front surface of the support body; each of the triggers is disposed on the first end and spaced from the rear surface or the front surface of the support body; each of the biasing elements is put on the extension and anchored between the second enlargement and the vertical section of the bending member; and the second end passes through the third through hole of the vertical section of the bending member to be proximate to the lock with both the inclined section and a portion of the extension disposed between the vertical section of the bending member and the retaining member; and the first enlargement is stopped by the rear surface or the front surface of the support body in an inoperative position;

wherein the locking device is capable of operation such that, when one trigger is pushed and compresses the corresponding biasing element, the corresponding inclined section inserts through the second through hole of the corresponding retaining member to lift one of the snapping members, and the trough of the snapping member disengages from the corresponding one of the pegs, thereby unlocking one of the two-way travel drawers.

2. The lock device of claim 1, further comprising a lengthwise member disposed on an upper portion of the inner surface of one side of the support body, the lengthwise member being secured to a horizontal section of each of the bending members.

3. The lock device of claim 1, wherein the trough includes two opposite flat surfaces each connecting the curved surface, and a curved section interconnecting the flat surfaces.

4. The lock device of claim 1, further comprising a plurality of inner, rectangular plates threadedly secured to the front and rear flanges of the groove member.

5. The lock device of claim 1, wherein the bend includes a first through hole.

6. The lock device of claim 5, wherein the hook includes a hole member corresponding to the first through hole of the bend.

7. The lock device of claim 6, wherein the biasing member has one end one end fastened in the first through hole of the bend and an other end fastened in the hole member of the hook.

8. The lock device of claim 1, wherein the sliding member further includes an upper, bent stop member directly below the lock.

9. The lock device of claim 8, wherein the lock includes a threaded nut at one end mounted on one side of the support body, and an arm at an other end rotatably fastened in the nut so that a turning of the arm will be stopped when a top of the stop member is urged against by the arm.

* * * * *